United States Patent [19]

Sikora et al.

[11] Patent Number: 4,953,062

[45] Date of Patent: Aug. 28, 1990

[54] STROBE FLASH LAMP WITH FOCUSSED FRONT BEAM AND COLLIMATED LATERAL BEAMS

[75] Inventors: Thomas R. Sikora, Mesa, Robert I. Nagel, Chandler, both of Ariz.

[73] Assignee: Tomar Electronics, Inc., Gilbert, Ariz.

[21] Appl. No.: 373,145

[22] Filed: Jun. 28, 1989

Related U.S. Application Data

[63] Continuation of Ser. No. 196,379, May 20, 1988, Pat. No. 4,870,551.

[51] Int. Cl.[5] ..... F21V 5/02

[52] U.S. Cl. ..... 362/263; 362/61; 362/337; 362/338; 362/293

[58] Field of Search ..... 362/216, 263, 293, 327, 362/329, 335, 339, 340, 328, 337, 347

[56] References Cited

U.S. PATENT DOCUMENTS

| | | | |
|---|---|---|---|
| 2,238,493 | 4/1941 | Lintern et al. | 362/340 |
| 2,307,247 | 1/1943 | Tuck et al. | 362/340 X |
| 2,566,126 | 8/1951 | Franck | 362/340 X |
| 3,221,162 | 11/1965 | Heenan et al. | 240/22 |
| 3,253,276 | 5/1966 | Nagel | 340/383 |
| 3,329,812 | 7/1967 | Harling | 240/93 |
| 3,731,082 | 5/1973 | Blaylock | 240/10.5 |
| 3,833,828 | 9/1974 | Vivari | 313/111 |
| 4,115,843 | 9/1978 | Nagel | 362/291 |
| 4,142,179 | 2/1979 | Lowndes | 362/339 X |
| 4,504,889 | 3/1985 | Goldfarb | 362/200 |

OTHER PUBLICATIONS

Dietz Catalog Section 9, Auxiliary Fog/Driving Light (no date).

Dietz Catalog Section 6, Turn Signal Light (no date).

Westinghouse Model 7415A Sealed Beam Incandescent Bulb (no date).

2 x Tomar PAR 36 Drawings (no date).

*Primary Examiner*—Ira S. Lazarus

*Assistant Examiner*—Peggy Neils

*Attorney, Agent, or Firm*—Cahill, Sutton & Thomas

[57] ABSTRACT

A light fixture includes a parabolic reflector, a light source positioned at the focal point of the parabolic reflector and a lens assembly. The lens assembly includes a front lens for transmitting the primary beam reflected from the parabolic reflector. The lens assembly also includes a first lens section including one, two or more lateral focussing elements positioned between the front lens and the edge of the parabolic reflector to intercept omnidirectionally radiated light rays from the light source and to redirect the intercepted light rays into collimated lateral beams to illuminate selected areas at the side of the light fixture.

24 Claims, 3 Drawing Sheets

FIG. 6
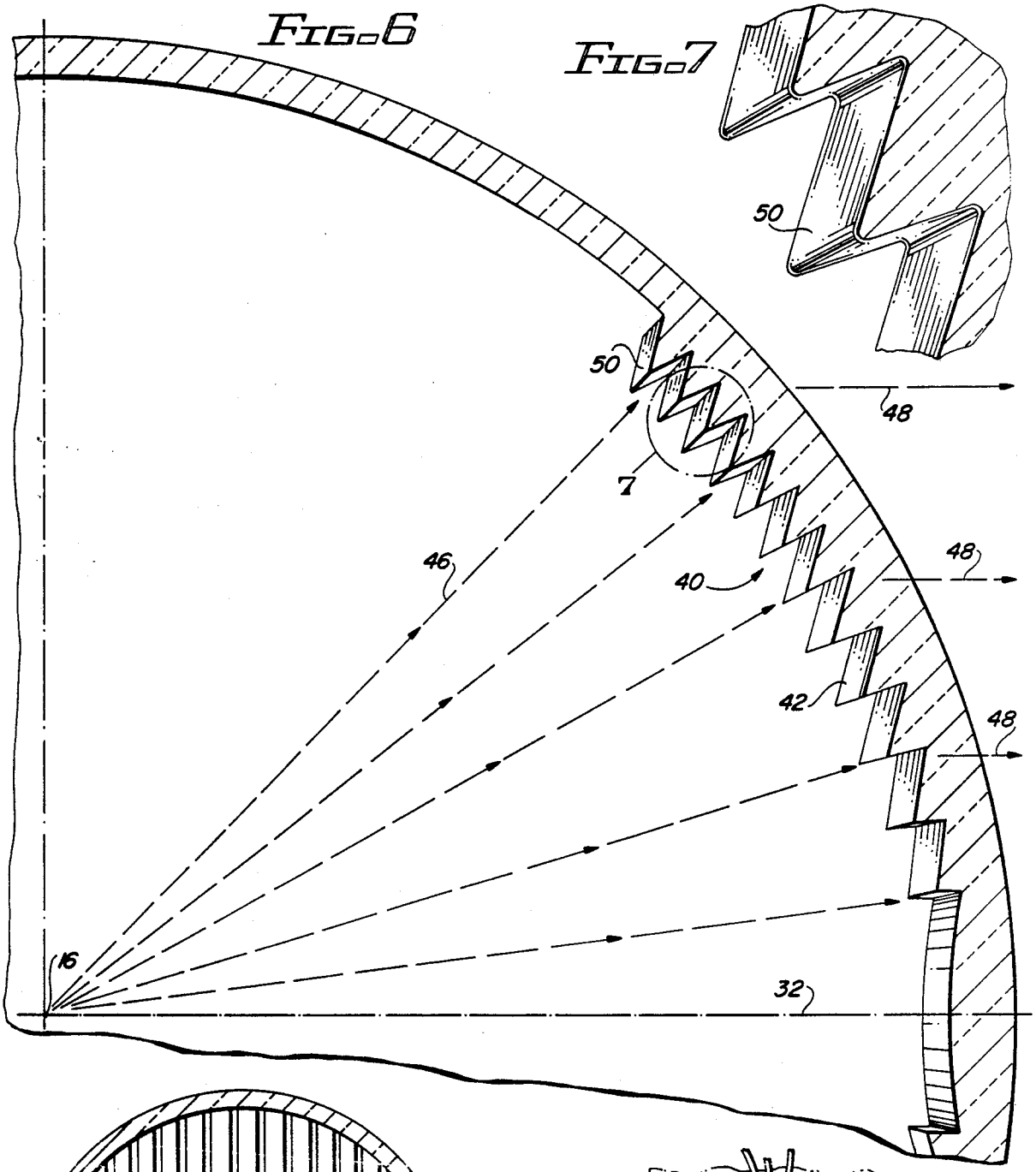
FIG. 7
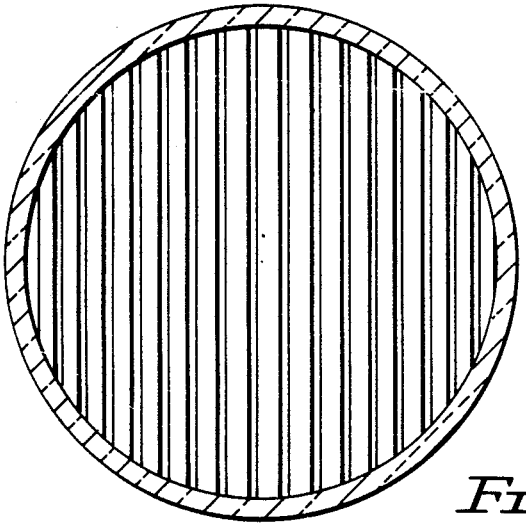
FIG. 5
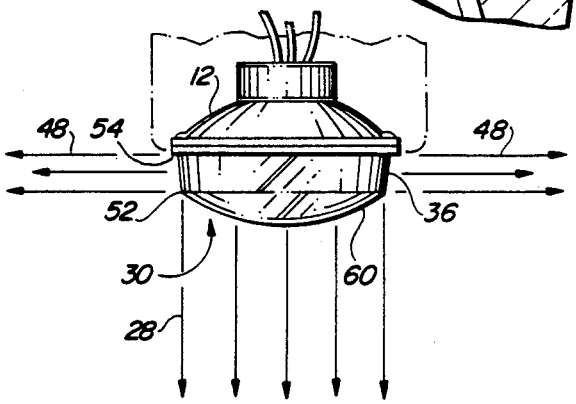
FIG. 8

STROBE FLASH LAMP WITH FOCUSSED FRONT BEAM AND COLLIMATED LATERAL BEAMS

This application is a continuation application of U.S. patent application Ser. No. 196,379, filed on May 20, 1988 now U.S. Pat. No. 4,870,551, issued on Sept. 26, 1989.

BACKGROUND OF THE INVENTION

1. Field of the Invention

This invention relates to light fixtures, and more particularly, to light fixtures having a parabolic reflector for generating a forward travelling primary beam.

2. Description of the Prior Art

Compartively small stobe flash lamp assemblies incorporating parabolic reflectors and front lenses have been used for a number of years on emergency vehicles such as police cars, police motorcycles, ambulances and fire engines. The high intensity, focussed pulsed output of these strobe lamp assemblies provides a readily noticed warning to motorists who must yield to the emergency vehicle. Due to the lack of protection afforded to a police officer riding a motorcycle and due to the small size of a motorcycle in comparison to other emergency vehicles, police officers responding to emergencies on a motorcycle have experienced a comparatively high accident rate. Even though the installation of strobe warning lights on motorcycles has reduced the accident rate in comparison to motorcycles utilizing lower intensity incandescent warning lamps, the accident exposure problem of motorcycles and other emergency vehicles has not been solved.

SUMMARY OF THE INVENTION

It is therefore a primary object of the present invention to provide a strobe flash lamp capable of producing both a focussed front beam as well as left and right collimated side beams to alert traffic located to the side of the emergency vehicle as well as to the front of the emergency vehicle.

Another object of the present invention is to provide a strobe flash lamp capable of producing both a focussed front beam as well as left and right collimated side beams which can be fabricated in a small physical size and at a reasonable cost to be adapted for application of emergency vehicles.

Another object of the present invention is to provide a strobe flash lamp capable of producing both a focussed front beam as well as left and right collimated side beams which can utilize a single xenon flash tube to generate both the front beam as well as both collimated beams.

Another object of the present invention is to provide a strobe flash lamp capable of producing both a focussed front beam as well as left and right collimated side beams which incorporated no moving parts and which can illuminate areas located essentially perpendicular to the axis of the front beam.

Briefly stated, and in accord with one embodiment of the invention, a light fixture includes a parabolic reflector having an apex and a focal point defining a first axis along which reflected light is radiated by the reflector. The parabolic reflector includes a perimeter surface defining a first plane which is oriented perpendicular to the first axis. The focal point of the reflector is located in front of the first plane. A light source is position at the focal point of the reflector for producing substantially omnidirectional light rays. The light rays directed toward the parabolic reflector are intercepted and redirected to form a forward travelling primary beam oriented parallel to and centered about the first axis. A lens assembly is coupled to the parabolic reflector and includes horizontal and vertical axes oriented perpendicular to the first axis. The lens assembly includes a first lens section having a lateral focussing element spaced apart from and oriented approximately parallel to the first axis. The first lens section intercepts omnidirectionally radiated light rays from the light source and redirects the intercepted light rays into a lateral beam oriented parallel to the horizontal axis of the lens assembly and perpendicular to the first axis. The lateral focussing element includes front and rear edges with the front edge intersecting the second plane and the rear edge intersecting a third plane. The second and third plane are oriented perpendicular to the first axis. The third plane lies at or between the first plane and the focal point while the second plane lying on the opposite side of the focal point. The width of the lateral focussing element along the first axis is defined by the spacing between the second and third planes. A front lens is coupled to the first lens section for transmitting the primary beam. The front lens generally lies entirely forward of the second plane.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG. 5 is a rear elevational view of the front lens illustrated in FIG. 2, taken along section line 5—5.

FIG. 6 is a partially cutaway elevational view of the first lens section, particularly illustrating the upper section of the Fresnel lens assembly.

FIG. 7 is a partially cutaway, enlarged view of a plurality of prism elements making up the Fresnel lens of the present invention as illustrated in FIG. 6.

FIG. 8 is a top plan view of the invention illustrated in FIG. 1.

DESCRIPTION OF THE PREFERRED EMBODIMENT

In order to better illustrate the advantages of the invention and its contributions to the art, a preferred hardware embodiment of the invention will now be described in some detail.

Figure 1:
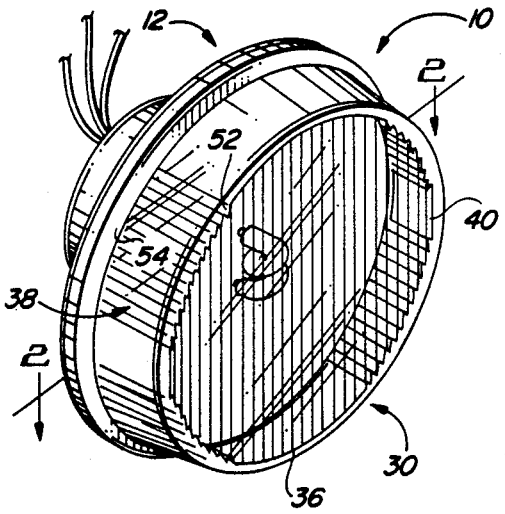
FIG. 1 is a perspective view of the preferred embodiment of the present invention.
Figure 2:
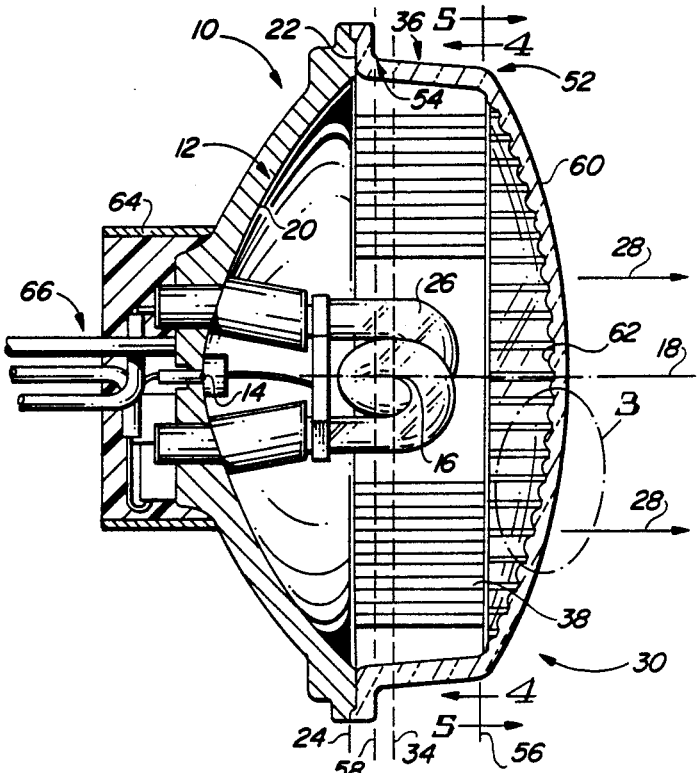
FIG. 2 is a sectional view of the embodiment of the invention illustrated in FIG. 1, taken along section line 2–2.
Figure 3:
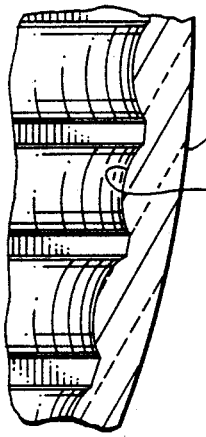
FIG. 3 is an enlarged sectional view of the designated section of the embodiment of the invention illustrated in FIG. 2.
Figure 4:
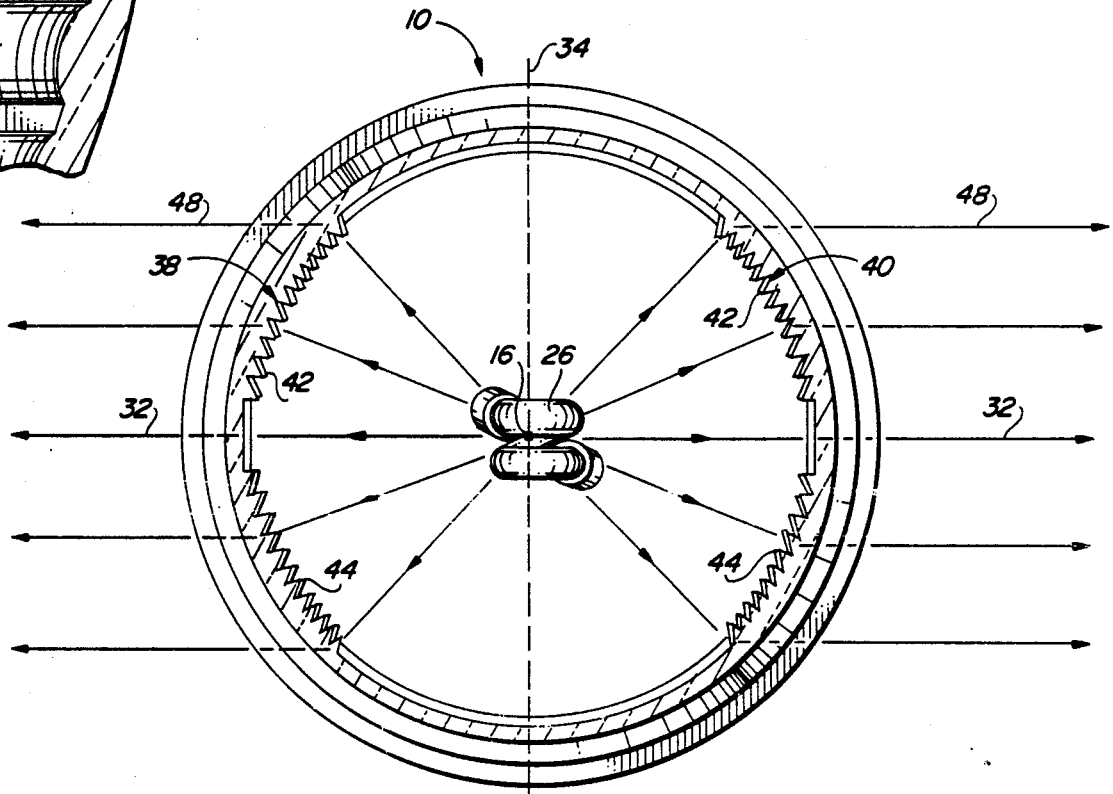
FIG. 4 is a front elevational view of the embodiment of the invention depicted in FIG. 2, taken along section line 4—4.

Referring now to FIGS. 1, 2 and 4, the preferred embodiment of the strobe flash lamp 10 includes a parabolic reflector 12 having an apex 14 and a focal point 16 which together define a first axis 18 parallel to which reflected light is radiated by the interior, parabolic reflective surface 20 of parabolic reflecter 12. Reflecter 12 includes a perimeter surface 22 which defines a first plate 24. In the preferred embodiment of the invention, first axis 18 is typically oriented in the horizontal plane while first plane 24 is aligned with the vertical plane. To achieve the objectives of the invention, focal point 16 of parabolic reflector 12 will always be located in front of first plane 24.

A light source 26 which in the preferred embodiment of the invention takes the form of a helical wound xenon flash tube is centered about focal point 16 of reflector 12. Light source 26 produces substantially omnidirectional light rays. The light rays radiated from light source 26 which are directed toward parabolic reflective surface 20 are intercepted and redirected by that surface to form a forward travelling primary beam 28 designated in FIG. 8 by the parallel set of arrows designated by reference number 28. Primary beam 28 is oriented parallel to and is normally centered about first axis 18.

A lens assembly 30 is coupled to parabolic reflector 12 around the perimeter surface or flange 22 of the reflector. Lens assembly 30 includes a horizontal axis designated by reference number 32 in FIG. 4 and a vertical axis designated by reference number 34. Horizontal axis 32 and vertical axis 34 are oriented perpendicular to or orthogonal to first axis 18.

Lens assembly 30 includes a first lens section 36 which includes a first lateral focussing element 38 and a second lateral focussing element 40. In the preferred embodiment of the invention, lateral focussing elements 38 are symmetrically disposed about horizontal plane 32 and about vertical plane 34. Each lateral focussing element includes an upper section 42 which lies above horizontal axis 32 and a lower section 44 which lies below horizontal axis 32.

As illustrated in greater detail in FIGS. 6 and 7, the lateral focussing elements in the preferred embodiment of the invention are fabricated as a cylindrical Fresnel lens. Each Fresnel lens is formed from a plurality of discrete prism surfaces joined together side to side. The prism sections of the upper and lower sections of each lateral focussing element are symmetrical about horizontal plane 32. The specific structure of each prism element is designed according to Snell's law to intercept the omnidirectionally radiated light rays designated by reference number 46 radiated from light source 26 and to redirect the intercepted light rays 46 into a lateral beam consisting of light rays oriented parallel to the horizontal axis 32 of lens assembly 36 as generally designated by reference number 48.

Since lens assembly 30 is typically fabricated from Lexan plastic, individual prism elements 50 which form the Fresnel lens are designed to have small enough dimensions to avoid injection molding problems, but large enough to permit accurate molding of the angles of each prism. As the angle of incidence of light rays 46 onto prism sections 50 increases toward the upper extremity of upper lens section 42 or toward the lower extremity of lower lens section 44, the percentage of light reflected by the prism sections increases while the percentage of light reflected and transmitted by each prism section decreases. This degradation of function at the edges of the Fresnel lens essentially determines the maximum distance away from horizontal axis 32 to which the Fresnel lens can be extended. The sectional views of the invention illustrated in FIG. 4 and FIG. 6 illustrated typical Fresnel lens configuration and termination points.

As illustrated in FIGS. 4 and 8, the lateral beams 48 produced by first lateral focussing element 38 and second lateral focussing element 40 are oriented perpendicular to first axis 18 and primary beam 28 and parallel to horizontal axis 32.

Each lateral focussing element includes a front edge 52 and a rear edge 54. Front edge 52 of each lateral focussing element intersects a second plane 56 while the rear edge 54 of each lateral focussing element intersects and terminates at a third plane 58. As illustrated in FIG. 2, second plane 56 and third plane 58 are parallel to first plane 24 and are parallel to each other. All three of these planes are perpendicular to first axis 18. Depending on the particular configuration of first lens section 36, second plane 56 will either by coincident with first plane 24 or will lie between first plane 24 and the focal point 16 of parabolic reflector 12. Third plane 58 will always lie on the opposite side of focal point 16 from the side on which second plane 56 lies as illustrated in FIG. 2. The width of the first lateral focussing element 38 and of the second lateral focussing element 40 along first axis 18 is defined by the spacing between second plane 56 and third plane 58.

A front lens 60 is coupled to first lens section 36 and transmits the primary beam 28. Front lens 60 lies entirely forward of second plane 56. As illustrated in FIG. 2, front lens 60 may include a plurality of vertically oriented convex lens elements 62 which receive and spread primary beam 28.

A trigger pulse transformer 44 is adhesively secured to the rear surface of parabolic reflector 12. Three power supply input leads designated by reference number 66 provide high level DC power input pulses, trigger pulses and a ground path for energizing xenon flash tube 26.

In operation, xenon flash tube 26 generates an optical output along the entire length of the helical wound envelop of the tube and thereby generates an optical output which produces a nearly spherical optical output created by the nearly spherical radiating surface of the helical wound flash tube coil. The helical wound configuration of flash tube 26 is for best performance centered about the focal point 16 of parabolic reflector 20. As best illustrated in FIG. 2, substantially all of the envelop of the helical wound flash tube 26 is positioned behind the second plane 56 and in front of the third plane 58. Flash tube 26 produces an optical output signal across substantially the entire width of the first and second lateral focussing elements 38 and 40.

Referring now to FIGS. 9A–9D, the reason for the requirement that the focal point 16 of parabolic reflector 20 lie between second plane 56 and third plane 58 will be described in detail. In each figure, the strobe light is centered about the parabolic reflector focal point.

Figure 9A:
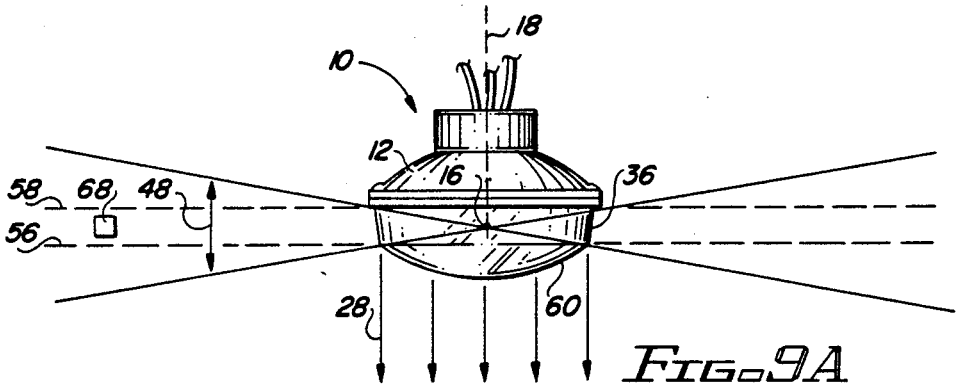
FIG. 9A–9D represent a series of top plan views illustrating the effect of the lateral beam of displacements of the parabolic reflector focal point and the light source along first axis 18.

In FIG. 9A, focal point 16 is essentially centered between second plane 56 and third plane 58 to thereby create a lateral beam 48 which illuminates a rectangular segment designated by reference number 68 which is positioned at a location between second plane 56 and third plane 58 at a point perpendicular to first axis 18. The illumination of this particular relative location with respect to the strobe flash lamp assembly is the primary object of the entire invention.

Figure 9B:
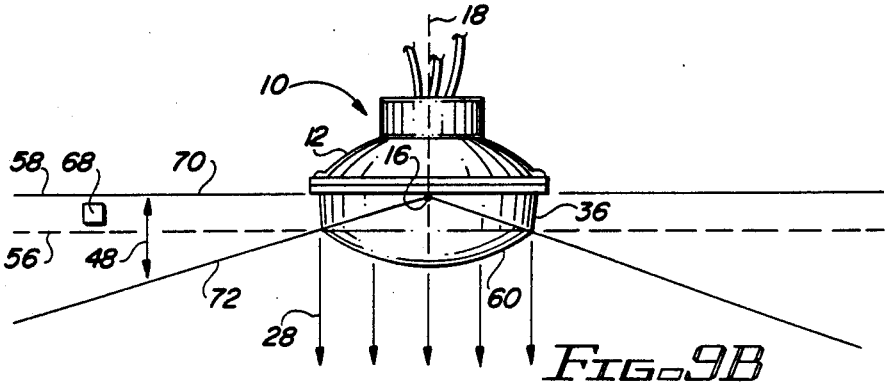

In FIG. 9B, focal point 16 has been moved to a location nearly coincident with third plane 58 and is on the verge of transitioning from the location in front of first plane 24 into the interior of the parabolic reflector envelop 20 of parabolic reflector assembly 12. With this inward limitation location for focal point 16, the width of lateral beam 48 is defined by a first ray 70 which is directed within third plane 58 and by second ray 72 which radiates angularly well beyond second plane 56. At this rearward limiting location for focal point 16, lateral beam 48 is still capable of illuminating rectangular segment 68 which is located at a point ninety degrees relative to first axis 18 and adjacent to strobe lamp assembly 10.

Figure 9C:
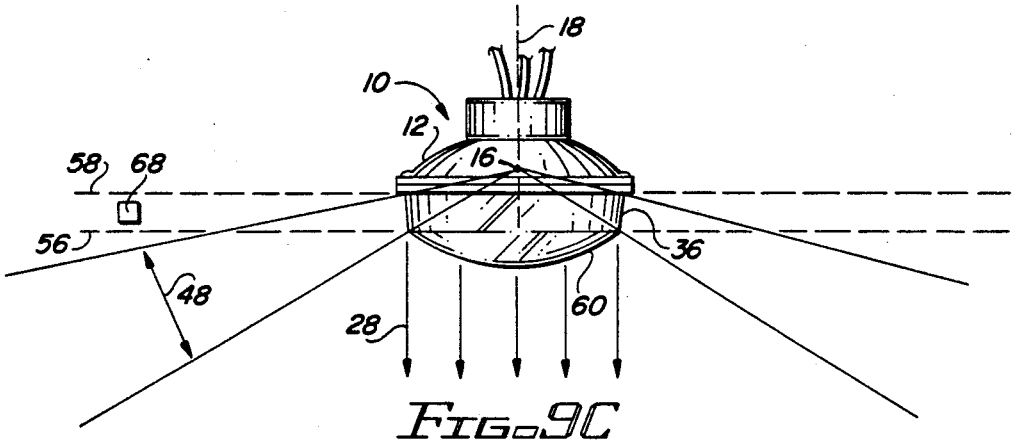
Figure 9D:
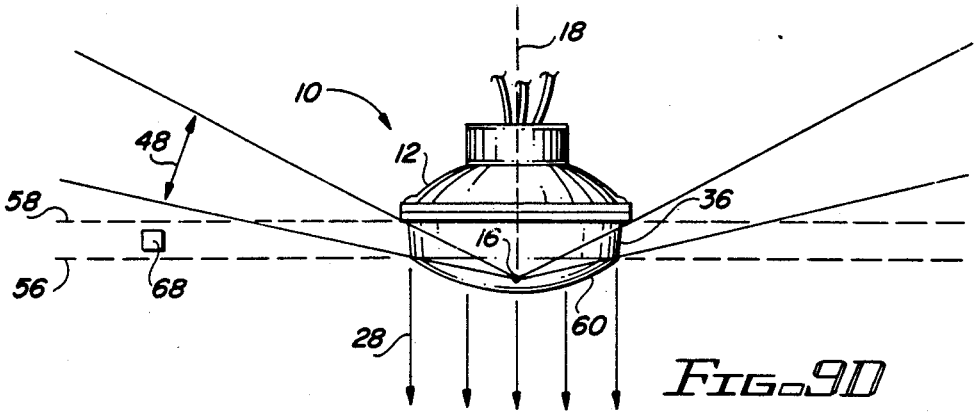

FIGS. 9C and 9D illustrate the operation of a strobe lamp utilizing a parabolic reflector having a focal point 16 which is placed outside the limits of the present invention. In FIG. 9C, focal point 16 has been displaced beyond first plane 24 into the interior of the parabolic surface area 20. Lateral beam 48 now radiates entirely in a forward direction and is incapable of illuminating element 68 at a location substantially perpendicular to the strobe flash lamp assembly 10.

In the FIG. 9D illustration, focal point 16 of parabolic reflector assembly 12 has been moved to a location in front of second plane 56. Light source 26 now produces lateral beams 48 which are directed behind element 68, once again failing to meet the objectives of the present invention.

In the embodiment of the invention depicted in FIG. 4, first and second laterally focussing elements 38 and 40 extend about 45° above and about 45° below horizontal axis 32 and therefore occupy 180° of the total circumference of first lens section 36. For the Fresnel lens embodiment of the lateral focussing elements, the maximum practical inclination to the horizontal axis is reached at an angle of about 50°. With other more complex and more expensive lens configurations, the lateral focussing elements could extend up to 90° above the horizontal axis. To provide a laterally directed light beam having a minimum practical intensity, it is desirable to extend the lateral focussing elements to an angle of at least about 10° above the horizontal axis.

For the embodiment of the invention depicted in the drawings, each laterally directed beam has a total intensity equal to about twenty percent of the main beam intensity. For various configurations of front lens 60 forming a high intensity narrow beam to a substantially lower intensity wide beam, the relative intensity of each laterally directed side beam can be varied from as low as one percent to as high as fifty percent of the main beam intensity.

The table below states various dimensions of the preferred embodiment of the invention illustrated in the drawings:

TABLE OF PHYSICAL DIMENSIONS

| MEASUREMENT | DESCRIPTION OF MEASUREMENT |
|---|---|
| 4.460" | Diameter along first plane 24 |
| 4.00" | Diameter along vertical axis 34 |
| 2.064" | Diameter trigger pulse transformer 64 |
| 0.700" | Front to rear length of lens assembly 30 from front surface to third plane 58 |
| 1.01" | Depth of parabolic reflector from apex 14 to the plane of the perimeter surface 22 |
| 4.185" | Active diameter of parabolic reflector |

Strobe flash lamp assemblies of the type described above are particularly useful for police motorcycle applications. In such applications, the ability of the present invention to produce opposing, laterally directed beams when the strobe light is operated in a flash mode provides a substantially enhanced attention getting feature directed toward motorists converging on a motorcycle patrolman from lateral roadways leading into an intersection. When responding to an emergency, motorcycle patrolmen are frequently required to run red lights and to drive through an intersection having laterally converging traffic viewing a green light indication from the traffic signal. The high intensity laterally directed flashes produced by the present invention causes such laterally converging motorists to see the motorcycle patrolman at the earliest possible time and to stop before creating a dangerous situation for the police officer.

The strobe flash lamp assemblies of the present invention can be coupled either to the front handlebars of a motorcycle or to the rear of the motorcycle where the primary beam will be directed to the rear. For optimum safety, strobe flash lamp assemblies of the present invention will be attached to both the front and the rear of the motorcycle to provide an even more enhanced attention getting feature.

It will be apparent to those skilled in the art that the disclosed strobe flash lamp with focussed front beam and collimated lateral beams may be modified in numerous ways and may assume many embodiments other than the preferred forms specifically set out and described above. For example, it is not necessary that the front and rear edges of the lateral focussing elements be configured to be parallel to each other. The present invention will still operate adequate if these two edges are inclined with respect to one another although in such a configuration the overall size and intensity of the laterally radiated beams will be reduced. The lateral focussing elements may also be configured in an oval, circular or other configuration depending on the general configuration of the particular type of parabolic reflector utilized and the overall shape of the lens assembly in which the lateral focussing elements are disposed. Parabolic assembly 12 may be configured in the circular form shown or in the more rectangular parabolic reflector configuration as embodied in the currently utilized rectangular headlight bulbs for domestic automobiles. Lens assembly 30 may be fabricated to be entirely optically transparent or may include selected segments which are either translucent or opaque. This lens assembly may be tinted to create beams having desired colors other than the normal white light output pulses generated by a xenon strobe flash lamp. Accordingly, it is intended by the appended claims to cover all such modifications of the invention which fall within the true spirit and scope of the invention.

We claim:

1. A directional lamp with a forward travelling, enhanced intensity primary beam and at least one enhanced intensity lateral beam, comprising a. a reflector having an apex and a focal point defining a primary axis along which reflected light is radiated by the reflector, the reflector including a perimeter surface defining a first plane oriented perpendicular to the primary axis, the reflector focal point being located in front of the first plane;

b. a light source positioned in proximity to the reflector focal point and lying substantially entirely in front of the first plane for producing substantially omnidirectional light rays including laterally travelling, vertically diverging rays radiating beyond the reflector perimeter with some of the laterally travelling rays being oriented perpendicular to the primary axis, the light rays directed toward the reflector being intercepted and redirected to form a forward travelling, substantially horizontally oriented enhanced intensity primary beam including a component oriented substantially parallel to the primary axis;

c. a front lens spaced apart from and positioned in front of the first plane and being optically coupled to the reflector and to the light source for transmitting the primary beam along the primary axis; and d. a lateral focussing element extending across at least a part of the space between the first plane and the front lens and laterally offset from the light source for intercepting laterally travelling, vertically diverging rays from the light source along a defined arc and for redirecting the unfocussed, vertically diverging intercepted light rays into an enhanced intensity lateral beam angularly spaced apart within a horizontal plane from the primary beam, the lateral beam including a component oriented substantially parallel to a horizontal axis, whereby the lateral beam illuminates a target offset to the side of the primary beam.

2. The directional lamp of claim 1 wherein the lateral beam also includes a component oriented substantially perpendicular to the primary beam.

3. The directional lamp of claim 1 wherein the lateral focussing element converges incident light rays.

4. The directional lamp of claim 3 wherein the lateral focussing element is formed as a cylindrically shaped section and further includes a first section extending above the horizontal axis and a second section extending below the horizontal axis.

5. The directional lamp of claim 4 wherein the first and second sections of the lateral focussing element each include a height and wherein the height of the first section is substantially equal to the height of the second section.

6. The directional lamp of claim 5 wherein the lateral focussing element includes front and rear edges and wherein the front and rear edges of the lateral focussing element are parallel.

7. The directional lamp of claims 1 and 5 wherein the lateral focussing element includes a first lateral focussing element disposed on one side of the primary beam to produce a first lateral beam travelling out a first side of the directional lamp and a second lateral focussing element disposed on the opposite side of the primary beam to produce a second lateral beam travelling out a second side of the directional lamp.

8. The directional lamp of claim 7 wherein the reflector includes a parabolic reflector.

9. The directional lamp of claim 7 wherein the focal point of the reflector is located behind the front lens.

10. The directional lamp of claim 7 wherein the lateral focussing element includes a Fresnel lens.

11. The directional lamp of claim 7 wherein the light source includes a xenon flash tube configured as a helical coil.

12. The directional lamp of claim 11 wherein the reflector includes a parabolic reflector and wherein the perimeter surface of the parabolic reflector includes a circular configuration.

13. The directional lamp of claim 7 wherein the front lens and the first and second lateral focussing elements are formed as a single lens assembly.

14. The directional lamp of claim 13 wherein the lens assembly is optically transparent and is tinted to create a colored primary beam and colored first and second lateral beams.

15. The directional lamp of claim 14 wherein the front lens includes a plurality of vertically oriented convex lens elements for receiving and spreading the primary beam.

16. The directional lamp of claim 10 wherein the Fresnel lens of the lateral focussing element is formed as a plurality of discrete prisms coupled side to side, the Fresnel lens prisms lying above the horizontal axis representing a mirror image of the prism lying below the horizontal axis.

17. The directional lamp of claim 11 wherein substantially the entire length of the xenon flash tube generates an optical output to produce a nearly spherical optical output and wherein the flash tube helical coil forms a nearly spherical radiating surface separated from but centered about the focal point of the reflector.

18. The directional lamp of claim 17 wherein the helical coil flash tube is positioned substantially entirely in front of the first plane.

19. The directional lamp of claim 18 wherein the helical coil flash tube is positioned substantially entirely behind the front lens.

20. The directional lamp of claim 8 wherein the parabolic reflector includes a rear surface to which a trigger pulse transformer assembly is coupled.

21. The directional lamp of claim 20 wherein the trigger pulse transformer assembly includes three power supply input leads for receiving DC power input pulses, trigger pulses and a ground path.

22. The directional lamp of claim 21 wherein the reflector includes a rear surface and a wherein the trigger pulse transformer assembly is secured to the rear surface of the reflector.

23. The directional lamp of claim 11 wherein the xenon flash tube includes a first and second ends and wherein the reflector includes a standoff assembly centered about and extending forward from the reflector apex for securing the first and second ends of the flash tube in a fixed position relative to the reflector focal point with the helical coil of the flash tube positioned substantially entirely in front of the first plane.

24. The directional lamp of claim 23 wherein the reflector includes a rear surface to which a trigger pulse transformer assembly is coupled, wherein the trigger pulse transformer assembly includes three power supply input leads for receiving DC power input pulses, trigger pulses and a ground path, and wherein the three power supply input leads extend from the trigger pulse transformer assembly, through the reflector and the standoff assembly and are coupled to the flash tube.

* * * * *